US009901155B2

(12) United States Patent
Nuzzo et al.

(10) Patent No.: US 9,901,155 B2
(45) Date of Patent: Feb. 27, 2018

(54) HAIR STYLING APPLIANCE FOR FORMING CURLS WITH DIFFERENT SIZES

(71) Applicant: L'OREAL, Paris (FR)

(72) Inventors: Stefania Nuzzo, Paris (FR); Sandy Lapize, Paris (FR); Eddy Ngo, Lyons (FR); Regis Fereyre, Chavanay (FR); Martial Maisonneuve, Villefontaine (FR)

(73) Assignee: L'OREAL, Paris (FR)

( * ) Notice: Subject to any disclaimer, the term of this patent is extended or adjusted under 35 U.S.C. 154(b) by 96 days.

(21) Appl. No.: 14/750,184

(22) Filed: Jun. 25, 2015

(65) Prior Publication Data

US 2015/0289620 A1 Oct. 15, 2015

(30) Foreign Application Priority Data

Jul. 2, 2014 (FR) ..... 14 56326

(51) Int. Cl.
*A45D 1/00* (2006.01)
*A45D 2/00* (2006.01)
(Continued)

(52) U.S. Cl.
CPC ..... *A45D 2/002* (2013.01); *A45D 1/04* (2013.01); *A45D 1/06* (2013.01); *A45D 1/18* (2013.01); *A45D 2/02* (2013.01); *A45D 7/02* (2013.01)

(58) Field of Classification Search
CPC ... A45D 1/00; A45D 1/04; A45D 1/06; A45D 1/08; A45D 1/18; A45D 2/001;
(Continued)

(56) References Cited

U.S. PATENT DOCUMENTS

2010/0012143 A1 1/2010 Simond et al.
2010/0224206 A1 9/2010 Serresvives et al.
(Continued)

FOREIGN PATENT DOCUMENTS

EP 1396208 A1 3/2004
EP 1652445 A1 5/2006
(Continued)

OTHER PUBLICATIONS

French Search Report for French Application No. 1456326, dated Mar. 27, 2015.
(Continued)

*Primary Examiner* — Rachel Steitz
(74) *Attorney, Agent, or Firm* — The Marbury Law Group, PLLC

(57) ABSTRACT

The invention relates to a hair styling appliance (1) for curling and straightening hair, comprising:
- a first and a second elongate jaw (2, 3) that are pivotable with respect to one another,
- the first jaw (2) having a first housing (6) bearing a first flat internal treatment surface (4), and
- the second jaw (3) having a second housing (7) bearing a second flat internal treatment surface (5),
- the internal surfaces (4, 5) being intended to pinch a lock of hair,
- at least one heating element (41, 51) intended to heat at least one internal treatment surface (4, 5).

According to the invention, the greatest width l1 of the first housing (6) is less than or equal to 90% of the greatest width l2 of the second housing (7), and at least one of the first housing (6) and the second housing (7) is asymmetric with respect to the median plane in longitudinal section of said first housing (6) or said second housing (7), respectively.

14 Claims, 3 Drawing Sheets

(51) Int. Cl.

| | |
|---|---|
| ***A45D 1/04*** | (2006.01) |
| ***A45D 7/02*** | (2006.01) |
| ***A45D 1/06*** | (2006.01) |
| ***A45D 1/18*** | (2006.01) |
| ***A45D 2/02*** | (2006.01) |

(58) Field of Classification Search
CPC . A45D 2/002; A45D 2/02; A45D 7/00; A45D 7/02
See application file for complete search history.

(56) References Cited

U.S. PATENT DOCUMENTS

| | | | | |
|---|---|---|---|---|
| 2010/0269848 | A1* | 10/2010 | Morgandi | A45D 1/04 132/269 |
| 2010/0288298 | A1 | 11/2010 | Serresvives et al. | |
| 2011/0079238 | A1* | 4/2011 | Takehana | A45D 1/04 132/269 |
| 2012/0111356 | A1 | 5/2012 | Vacheron et al. | |
| 2013/0247407 | A1* | 9/2013 | Richmond | A45D 20/10 34/283 |
| 2013/0247933 | A1* | 9/2013 | Oh | A45D 1/18 132/269 |
| 2014/0261522 | A1* | 9/2014 | Smith | A45D 1/14 132/211 |

FOREIGN PATENT DOCUMENTS

| | | | |
|---|---|---|---|
| EP | 2145557 | A1 | 1/2010 |
| EP | 2591698 | A1 | 5/2013 |
| GB | 2498417 | A | 7/2013 |
| KR | 10-2012-0054897 | A | 5/2012 |
| WO | 2009/077672 | A2 | 6/2009 |
| WO | 2009/078046 | A1 | 6/2009 |
| WO | 2011/124137 | A1 | 10/2011 |
| WO | 2013/153320 | A1 | 10/2013 |

OTHER PUBLICATIONS

English language abstract for KR 10-2012-0054897A, dated May 31, 2012.

* cited by examiner

HAIR STYLING APPLIANCE FOR FORMING CURLS WITH DIFFERENT SIZES

This application claims priority to French Application No. 1456326, filed on Jul. 2, 2014.

TECHNICAL FIELD OF THE INVENTION

The present invention relates to a hair styling appliance intended for shaping by contact with the hair, in particular intended for straightening but also for curling the hair of a person.

PRIOR ART

Traditionally, two different types of hair styling appliance for straightening or curling are known: heated or non-heated rollers, straighteners or straightening tongs and curlers or curling tongs.

Appliances of the straightening- or curling-tong type generally have two jaws that pivot with respect to one another about a common axis, and each comprise an end that carries a treatment surface, at least one of the treatment surfaces being heated, the other being provided to bring the hair into contact with the first, in particular by passing from an open position of the jaws, for inserting the hair, to a closed position in order to bring the hair into contact with the heated part.

A straightener has, at a first end of its jaws, two identical flat heated surfaces that pinch the hair. Moreover, the other end of the jaws forms two handles that act as a gripping zone and make it possible to pass from the open position to the closed position. This passage takes place manually by the two articulated handles of the appliance being pressed towards one another in order to bring the treatment surfaces into contact with the hair. A lock of hair is straightened by the appliance being moved along this lock, from the root to the end by way of a straight translational movement of the closed appliance.

A curler has surfaces formed by a heated cylindrical barrel having a clamp that pinches the end of the lock by pivoting on the barrel before winding the entire lock around the barrel. A lock of hair is curled by the lock being wound at least partially around the treatment surface or surfaces and by the application of heat in order to fix the curl mainly statically.

Straightening appliances that operate with steam, such as those described by the applicant in WO2009077672 and in EP2591698, are known. The straightener from the second document cited is illustrated in FIG. 1. It has straightening tongs having two identical flat straightening plates located opposite one another, and steam outlet orifices. The steam straightener as described in EP2591698 and illustrated in the present application is considered in FIG. 1 to be the closest prior art. This currently marketed appliance is perfectly satisfactory in terms of straightening and is capable of producing a flow rate of steam that is sufficient for providing a high degree of care to the capillary fibre. However, in order to produce excellent straightening and a consistent flow rate of steam, this appliance contains numerous internal elements which are in a technically optimal configuration but take up a relatively large amount of space compared with conventional straightening tongs. Specifically, the jaw which produces the steam contains a vaporization chamber. Thus, the two housings or the two shells that hold the plates and the vaporization chamber each have an external cover which, in cross section, has an identical width or greatest width.

However, the two covers delineate an asymmetric external line that is relatively flat, in particular in the region of the steam function, that is to say at the steam orifices and the deflector facing the orifices.

Thus, if the user wishes to use this appliance to form curls by winding the lock around one cover or both covers, he will not be able to form a perfectly round curl or to form a perfectly regular curl or to slide in a fluid and regular manner in order to remove the curl once it has been formed.

SUMMARY OF THE INVENTION

The object of the present invention is to at least partially remedy the abovementioned drawbacks and to propose a less bulky straightener that is capable of forming regular curls.

Another object is to propose a less bulky straightener that is capable of forming curls by way of an easy mode of use.

Another object is to propose a straightener that is capable of forming curls of at least two different sizes (or diameters) or even at least three different sizes (or diameters) by way of easy use of this single appliance.

Another object is to provide a straightener that is capable of forming curls at a reduced cost price.

Another object is to provide a straightener that is capable of forming curls and has a reduced weight.

Another object is to provide a straightener that is capable of forming curls and is easy to handle, in particular easy to handle in the region of the two handles or gripping zones and without touching the end of the appliance on the treatment side, which may sometimes be hot.

Another object of the invention is an appliance for shaping by contact with the hair, said appliance being effective and/or rapid in operation.

Another object of the invention is an appliance for shaping by contact with the hair as per the choice of hairstyle to be produced and/or as per the choice of the user without having to attach additional accessories.

Another object of the invention is an appliance for shaping by contact with the hair, said appliance allowing easy and practical use.

Another object of the invention is an appliance for shaping by contact with the hair, using additional disposable elements that are of simple design and of low-cost design.

Another object of the invention is an appliance for shaping by contact with the hair, said appliance being safe and never being able to burn the scalp or the hands of the user.

These objects are achieved, according to a first aspect of the invention, by a hair styling appliance for curling and straightening hair, comprising a first and a second elongate jaw that are pivotable with respect to one another, the first jaw having a first housing bearing a first flat internal treatment surface, and the second jaw having a second housing bearing a second flat internal treatment surface, the internal surfaces being intended to pinch a lock of hair, at least one heating element intended to heat at least one internal treatment surface. In this appliance, the greatest width $l1$ of the first housing is less than or equal to 90% of the greatest width $l2$ of the second housing. This feature, contrary to all conventional specifications of a straightener which should have identical housing widths, makes it possible to provide different housings and thus makes it possible to produce curls of different sizes around one housing or both housings in the closed position, while retaining an appliance that is simple and occupies little space. The greatest width is considered to be the basis for the size relationship between the two housings.

In addition, in this appliance, at least one of the first housing and the second housing is asymmetric with respect to the median plane in longitudinal section of said first housing or said second housing, respectively. This feature makes it possible to obtain curls having a non-constant radius of curvature, for a more natural effect.

More particularly, according to the invention, the greatest width l1 of the first housing is between 75% and 85% of the greatest width l2 of the second housing, preferably equal to 80%. This allows each housing to hold all the interior technical elements while limiting the overall external space requirement of the two covers or two shells that hold the part for treating the hair.

According to the invention, in the closed position of the jaws, the median plane P1 in longitudinal section of the first housing is parallel to and separate from the median plane P2 in longitudinal section of the second housing. This means that in cross section orthogonally to the longitudinal axis of the straightener, the section is not orthogonally symmetric with respect to the straightening plane P1. The straightening plane P1 is defined such that it contains the planar straightening zone formed by the two flat treatment surfaces against one another in the closed position of the appliance. Each of the two housings is arranged on each side of the straightening plane. Thus, in the treatment zone, the first housing is offset with respect to the second housing. This asymmetry or this offset makes it possible to provide an appliance the use of which will be intuitive for the user in a particular direction. This arrangement intuitively guides the user towards the most effective mode of use.

More particularly, according to the invention, the distance between said two median planes (P1, P2) is between 5% and 20% of the value of the greatest width l2 of the second housing, preferably equal to 10%. This offset is sufficiently pronounced to ergonomically guide the user.

According to the invention, in the closed position of the jaws, one of the two longitudinal edges of the first housing is vertically aligned with the longitudinal edge of the second housing arranged on the same side of the second housing. This means that in the closed position, two edges on the same side of the appliance are opposite one another (as is conventional for a straightener) and, especially, the two edges of the other side of the housing will be offset with respect to one another. On the side where the edges are vertically aligned, the curve formed by the contour of the two shells or housings will be relatively symmetric with respect to the straightening plane P1. The straightening plane P1 is the plane containing the straightening zone formed by the two surfaces in contact with one another. These two vertically aligned edges make it possible to form large curls by winding the lock around the two housings in the closed position of the appliance. These two vertically aligned edges make it possible to form a loose and perfectly round curl, that is to say one that is regular and without undesired marks with an appliance that is relatively compact with respect to the size of the curl obtained.

According to the invention, the internal treatment surfaces are flat, identical and opposite one another in the closed position, and are arranged in their respective housings and adjacent to said vertically aligned edges. The term "adjacent" is understood to mean as close as possible taking into consideration the manufacturing constraints, and taking account of the possible presence of a bar between the housing and the treatment surface. This means that the straightening treatment takes place on the side of the vertically aligned edges. In use on the lock to be treated, these edges should be arranged on the scalp side in order to allow the hair, from among the various combinations of treatments provided by the appliance (in particular straightening, or combing or brushing), to be subjected last to the straightening treatment and to ensure a perfect finish to the styling.

More particularly, according to the invention, each of said two longitudinal edges is provided with at least one bar that protrudes towards the interior of the housing and is made of the same material as that of said housings. This bar protrudes with respect to the contour of the housing and is oriented towards the interior of the housing. This bar ideally forms two surfaces with a right angle (and not a chamfer) and with one of the two surfaces being parallel to the treatment surface or surface of the adjacent straightening plate. This bar makes it possible, when the appliance is closed, to hold the lock under tension, to subject it to shear and to curl it more easily. This effect, referred to as the "ribbon" effect, can be compared with the effect of a scissor blade being slid along a gift ribbon in order to form curls therein. The bars are identical and arranged at the same place on the jaws in order to produce said "ribbon" effect in an identical manner whether the straightener is inclined upwards or downwards. The bar has a specific design and a surface state that allows the hair to have a frictional force against the bar that is greater than the frictional force against the external surface of the jaws. The surface state may be a rough coating.

According to the invention, the width of each internal treatment surface is between 40% and 60% of the greatest width l1 of the first housing, preferably between 40% and 50%, preferably more or less equal to 45%. More or less half of the width of the housings is taken up for producing the main treatment step, namely the straightening step necessary for straightening the lock which will then be curled as per the choice of the user.

According to the invention, the second housing comprises a comb or a brush that is oriented towards the first housing and adjacent to the second internal treatment surface. When the combing or brushing functions are provided in addition to the straightening function, the order of treating the lock is as follows: combing or brushing and then straightening.

More particularly, according to the invention, the first housing has a groove formed in its interior contour and arranged, in the closed position, more or less next to the comb or the brush of the second housing. This makes it possible to receive at least the free end of the comb or at least the free end of the brush line in the closed position while limiting the space requirement to the best possible extent, while protecting the end of the accessory (comb, brush, etc.) from any excessive tension to which it is subjected while the appliance passes in the closed position along the lock and which could damage the comb. The comb should not be in abutment against the upper housing before the heated plates come into contact.

According to the invention, the first handle of the first jaw and the second handle of the second jaw each have a width lp strictly less than the greatest width l1 of the first housing. This makes it easy for any size of hand to grip. The handles are in the longitudinal axial extension of the respective housings. The edges of the housings which are vertically aligned with one another are each in a particular configuration in which they are aligned (along the same straight line) with the corresponding edges of the handles. The asymmetry of the appliance is also pronounced in the region of the handles.

According to the invention, the exterior surface of the first housing and of the second housing at least covering the treatment zone formed by the treatment surfaces is substantially smooth. This makes it possible to slide along the locks to the best possible extent when the latter are wound around one or both housings and when they should be detached without affecting the shape of the curls produced, glossy surface state, Charmilles type 0 or 3. The roughness Ra of the surface referred to as more or less smooth will range from 0.2 μm to 2 μm, more particularly from 0.2 μm to 0.5 μm. At least one gripping zone may be disposed on the external surface of the housings. This gripping zone is designed to limit the transfer of heat so as to provide the possibility of new hand movements without a risk of burns when the jaws are held by way of the housings and not by way of the handles. By way of example, the surface of this gripping zone may be made of a different material or may have a surface state different from the rest of the external surface of each housing.

According to the invention, in cross section, the line defined by the exterior contour of the first and second housings is a rounded curve that does not have any points of inflection. According to another particular aspect, the line is never visually flat. This makes it possible to provide an appliance which has a reduced space requirement, is capable of forming curls and the overall contour of which is substantially rounded. For these reasons of space requirement and different capacity of the two housings, the exterior contour is not circular, however.

BRIEF DESCRIPTION OF THE DRAWINGS

The invention will be better understood from examining the embodiments which are given without implying any limitation and are illustrated herein.

DETAILED DESCRIPTION OF THE INVENTION

Figure 1:
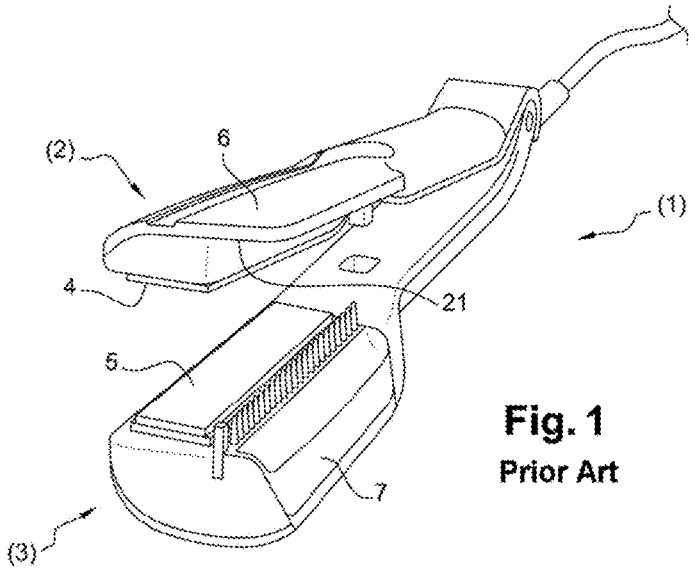
Fig. 1 Prior Art
FIG. 1 illustrates a perspective view of an appliance according to the prior art.

As illustrated in all of the figures—including FIG. 1 showing the prior art—the hair styling appliance 1 has a first jaw 2 and a second jaw 3 which are disposed opposite one another. Each jaw may be broken down at least operationally into two parts: a housing which holds the members for treating the hair and a handle for the user to hold in his hand. Each housing is formed in one piece. The housing and the handle may be in one piece in extension of one another. Thus, the first jaw 2 may be formed by a first housing 6 and the first handle 6' and the second jaw 3 may be formed by the second housing 7 and the second handle 7'. The first internal treatment surface 4 is borne by the first jaw 2, more precisely by the first housing 6, the second internal treatment surface 5 is borne by the second jaw 3, more precisely by the second housing 7. The two jaws 2, 3 are connected so as to pass between an open position and a closed position in which the internal treatment surfaces 4, 5 pinch a lock of hair. The first surface 4 and the second surface 5 for treating hair are complementary flat surfaces which, in the closed position of the appliance, come substantially into correspondence in order to pinch the lock of hair, thus making it possible to straighten it when the lock is slid along with a straight translational movement. The two treatment surfaces are substantially symmetric with respect to the straightening plane when the appliance is in the closed position. Similarly, the heating elements of each treatment surface are substantially symmetric with respect to the straightening plane when the appliance is in the closed position. The first jaw 2 and the second jaw 3 are connected by an articulation of the hinge type and the maximum opening angle α of the two jaws is between 5° and 60°, or between 10° and 20°, and preferably equal to around 15°. In addition, the appliance still illustrated herein is in an "open" rest position, but it may be in a "closed" rest position, as illustrated in the patent EP2145557, said jaws being mounted so as to pivot at the other end between an open position allowing the insertion of the hair between the two treatment surfaces and a closed position for bringing it into contact with the two treatment surfaces, the appliance having return means for the half-handles, which bring about the pressurization of the treatment surfaces. The pivot axis of the two jaws bearing the treatment surfaces may be placed at the end of the jaws (as illustrated herein) or be placed approximately in the middle of the jaws so as to provide an appliance having a "scissors" type articulation.

Figure 4:
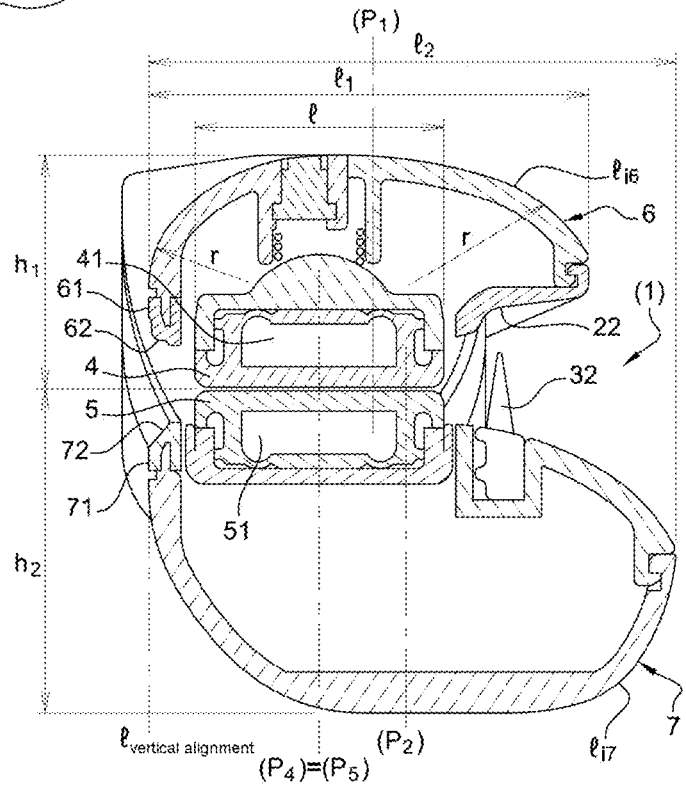
FIG. 4 illustrates a cross-sectional view of the housings according to the invention.

The material forming the treatment surfaces 4, 5 is composed of metal and/or ceramic and/or glass and/or plastics material and/or a fibrous part. At least one of the first and second housings has a single heating element intended to heat the corresponding treatment surface by contact and to heat the coating by radiation. The treatment surface is capable of reaching a temperature of between 130 and 230° C. The housing and the external handle are in one piece so as to form the jaw. The material forming the external part of the housing or even the external part of the handle may be made of plastics material, for example glass-fibre-filled PBT (polybutylene terephthalate). It is important for this material to have a very smooth surface. The material forming the internal part of the housing or even the internal part of the handle may be made of plastics material, for example glass-fibre-filled PET (polyethylene terephthalate). As illustrated in FIG. 4, the appliance 1 comprises at least heating means 41 for heating the first treatment surface 4. According to one particular embodiment, the appliance 1 also comprises heating means 51 for heating the second treatment surface. The heating means 41 and/or 51 may be a heating element which may be a PTC (positive temperature coefficient) thermistor or a piece of ceramic which is pressed against the treatment surface 4, 5 or arranged inside the element comprising the treatment surface 4, 5.

Figure 2:
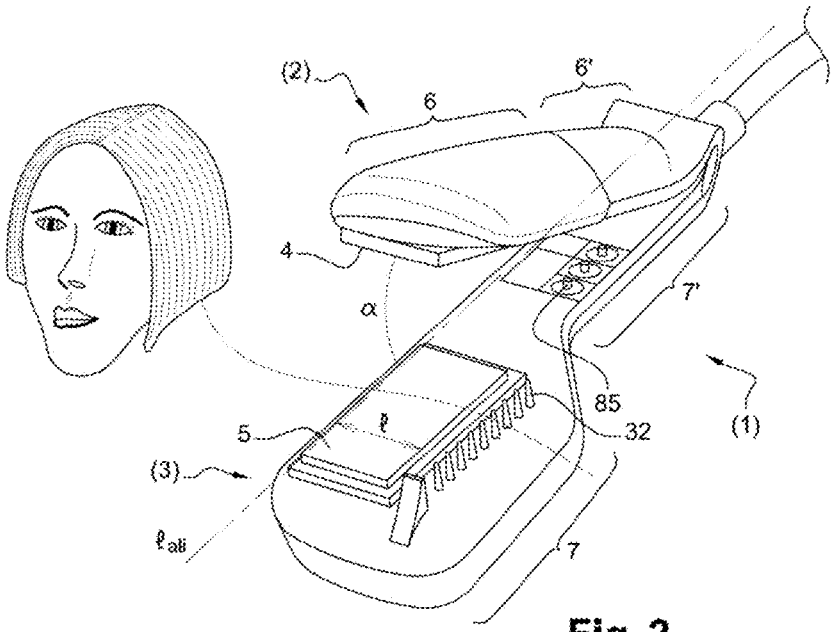
FIGS. 2 and 3 illustrate perspective views of an appliance according to the invention in the open position and in the closed position, respectively.
Figure 3:
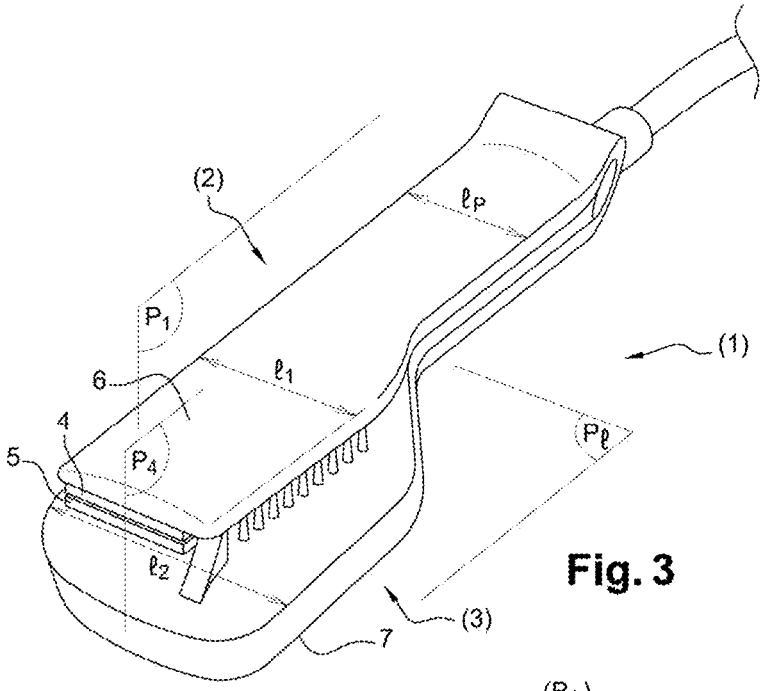

As illustrated in FIGS. 2, 3 and 4, in the hair styling appliance 1 for curling and straightening hair, the greatest width l1 of the first housing 6 is less than or equal to 90% of the greatest width l2 of the second housing 7. More particularly, the greatest width l1 of the first housing 6 is between 75% and 85% of the greatest width l2 of the second housing 7, preferably equal to 80%. These greatest widths are substantially constant over the housing, except for at the ends of each housing, it being for this reason that a range of values is given. FIG. 4 is furthermore a cross section more or less through the middle of the housings.

In the closed position of the jaws 2, 3, as illustrated in FIGS. 3 and 4, the median plane or sagittal plane P1 in longitudinal section of the first housing 6 is parallel to and separate from the median plane P2 in longitudinal section of the second housing 7. The distance between the two median or sagittal planes P1, P2 is between 5% and 20% of the value of the greatest width l2 of the second housing 7, preferably equal to 10%. Thus, the body of the two housings is not symmetric along a transverse longitudinal plane but offset. The contour of the appliance is clearly asymmetric and is used judiciously both to reduce the space requirement of the interior elements and to facilitate the method for using the straightener in order to form curls of different size. As shown in FIGS. 3 and 4, in the closed position of the jaws 2 and 3, one of the two longitudinal edges 61 of the first housing 6 is vertically aligned with the longitudinal edge 71 of the second housing 7 arranged on the same side of the second housing 7. The transverse longitudinal plane P4 and transverse longitudinal plane P5 are the median plane of the internal treatment surface 4 and of the internal treatment surface 5, respectively. In section as illustrated in FIG. 4, this plane P4 is parallel and offset towards the exterior with respect to the planes P1 and P2. The planes P4, P1 and P2 are mutually parallel and are each orthogonal to the straightening plane P1. Moreover, the first housing 6 and the second housing 7 in this example are also asymmetric with respect to their respective median planes (P1, P2) in longitudinal section.

As has been seen, the internal treatment surfaces 4, 5 are flat, identical and opposite one another in the closed position, and are arranged in their respective housings 6, 7 and next to said vertically aligned edges 61, 71. FIG. 4 shows the vertical alignment line, a straight line tangent to the edges 61 and 71 of the vertically aligned housings or covers. This straight line is orthogonal to the straightening plane P1. The curves of the contours li6 and li7 of the housings 6 and 7, respectively, form an arc of a circle which is substantially continuous at the vertically aligned edges 61 and 71 and thus the value of the arc of a circle is around 15 mm.

Figure 5:
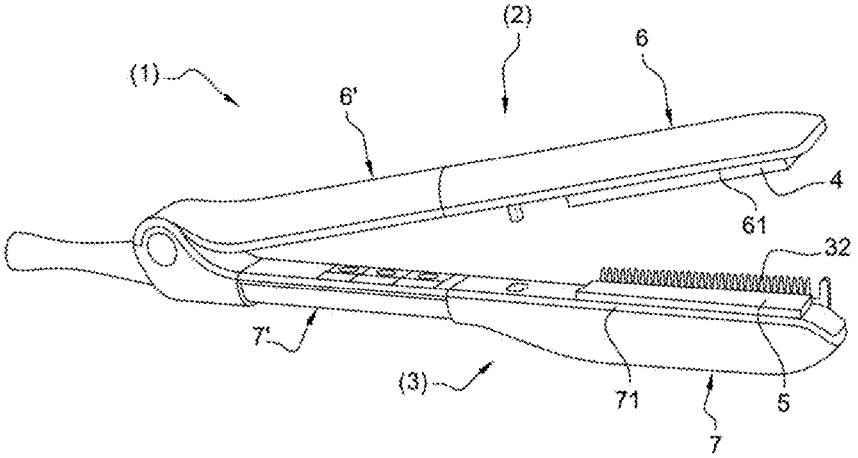
FIG. 5 illustrates a dimetric view of the appliance according to the invention on the side of the vertically aligned housing edges.

Each of said two longitudinal edges 61, 71 is provided internally with a bar 62, 72 protruding towards the interior of the appliance and preferably made of the same material (plastics material, for example PBT) as that of said housings 6, 7. These bars are arranged in an identical manner on the two housings, as illustrated in FIG. 5. They make it possible to apply a tension in order to give what is referred to as a "ribbon" effect to the hair which slides over one of these bars during the straightening movement. It is a first way of forming curls towards the inside or towards the outside, respectively, depending on the bar used, be it the bar arranged at the bottom or arranged at the top of the straightener used.

As illustrated in FIGS. 2 and 4, the width l of each internal treatment surface 4, 5 is between 40% and 60% of the greatest width l1 of the first housing 6, preferably between 40% and 50%, or more or less equal to 45%.

As illustrated in FIG. 4, there follows a nonlimiting example of the dimensions of the appliance according to the invention:

l1: greatest width of the first housing 6=45 mm l2: greatest width of the second housing 7=52 mm h1: greatest height of the first housing 6=23 mm h2: greatest height of the second housing 7=32 mm l: width of each internal treatment surface 4, 5=25 mm r: radius of curvature formed by the contour of each side of the first housing 6: around 14 mm.

The first jaw 2 has, for the treatment of hair, only a straightening plate, whereas the second jaw has, for the treatment of hair, a straightening plate and at least one additional hair styling function. Said at least one additional hair styling function may be one or more functions chosen from the following list: combing, brushing, ionizing, application of tension by a bar made of a silicone-type material, application of tension by a mobile bar made to carry out an oscillatory movement, for example. The present invention also provides a compact hair styling appliance having a hair styling function in addition to that of straightening and with the capacity of forming curls of at least two different sizes, or even of at least three different sizes. To this end, said additional hair styling function is installed on the wider housing of the two. The invention resides in the improved reduction in the width of the jaw housing that only has the straightening function without this causing failures in terms of safety or in terms of effectiveness of the hair styling appliance as a whole. Also, the formation of curls and the "demoulding" of the curls represented an additional constraint on the size and shape of the housings.

As illustrated in FIG. 4, the second housing 7 comprises a comb or a brush 32 that is oriented towards the first housing 6 and adjacent to the second internal treatment surface 5. In this case, the first housing 6 can have a groove 22 formed in its interior contour and arranged, in the closed position, more or less next to the comb or the brush 32 of the second housing 7. In this way, the comb properly separates the entire thickness of the lock, without the combing function taking up too much space.

As illustrated in FIGS. 2 and 3, the first handle 6' of the first jaw 2 and the second handle 7' of the second jaw 3 each have a width lp strictly less than the greatest width l1 of the first housing 6, that is to say than the smaller of the widths of the two housings 6 and 7. Also, the edges of the housings 6 and 7 which are arranged in vertical alignment are in these cases aligned with the edge on the same side of the handles in order to form a coincident alignment line $L_{ali}$ as illustrated in FIG. 2. It has been found that this alignment enhances the ergonomics of the appliance, which can be handled with any size of hand.

The exterior surface of the first housing 6 and of the second housing 7 is substantially smooth. The friction coefficient was measured via measurements of the roughness of the shell in the zone intended to wind the curls, as follows:

a) Measurement of Ra on the "flat" upper part or the part tangential to the horizontal of the shell 6 illustrated in FIG. 4:
   - In the longitudinal direction: 0.24; 0.23; 0.22 μm or 0.23 μm on average,
   - In the transverse direction: 0.22; 0.44; 0.27 μm or 0.31 μm on average, b) Measurement of Ra on the lateral part, to the left and to the right of the housing 6 illustrated in FIG. 4:
   - In the longitudinal direction: 0.24; 0.23; 0.43; 1.63 μm or 0.24 μm on average with localized peaks that can range up to 1.63 μm.

The roughness meter used is of the brand Mitutoyo, No JP1010. The statistical criterion Ra is statistical, and it is the mean arithmetic difference from the average line.

This allows easy winding and "demoulding" of the curls without damaging the lock of hair.

In cross section, as illustrated in FIG. 4, the line defined by the exterior contour of the first and second housings 6, 7 is a rounded curve that does not have any points of inflection. A major part of the work was to best define a contour of the housings that is as rounded and fluid as possible, without any points of inflection and depending on the space requirement of the interior elements and safety and effectiveness measures fixed by the appliance. It will be noted that in cross section, no planar line is visually detectable to the naked eye. At the first housing, the latter has arcs of a circle on the sides that are smaller than the arcs of a circle on the sides of the second housing. The radii of curvature of each side of the first housing 6 are more or less identical. This makes it possible to form curls that are as round as possible. This also makes it possible to avoid corners on the appliance that are sensitive to impacts. In cross sectional view, the exterior contour of the first housing 6 is roughly a reduction in the exterior contour in cross section of the second housing 7 by a ratio of around 0.8.

OPERATIONAL DESCRIPTION OF THE INVENTION

In operation, the user will connect the appliance to the electric power supply, the heating element of the CTP or ceramic type heats the surfaces intended to come into contact with the hair, the user grasps the appliance and applies it so as to pinch the lock of hair to be treated.

Since the two housings are asymmetric, the arrangement of the appliance on the lock is significant: the user has to arrange and close the straightener so that the two vertically aligned sides are closest to the scalp, the direction being illustrated in FIG. 2. Next, the user can carry out the conventional step of straightening by sliding the jaws in a rectilinear manner along the lock in the direction shown by the arrow marked on the first housing 6 in FIGS. 2 and 3.

When the user wishes to form small curls, he proceeds as follows: with the appliance 1 in the open position, he surrounds the first housing 6 with the lock of hair, then he closes the straightener closest to the scalp, keeping it immobile for a few seconds, and then slides the appliance 1 towards the free end of the lock in order to "demould" the lock. This makes it possible to form small curls.

When the user wishes to form larger curls, he proceeds as follows: once the appliance has been closed closest to the scalp, he slides it along the entire lock and, at the end of the lock, he keeps the appliance in the closed position and turns it about itself in order to wind the lock around the two housings 6, 7 in the closed position as far as the scalp, then, after a few seconds, he unwinds the lock. This makes it possible to form large curls.

Each static step can last for a few seconds or even one or two minutes, the time for which the curls form correctly. The duration of the pause varies in particular depending on the temperature of the appliance and on the format of lock treated.

Advantages of the Invention

The invention provides numerous advantages, including proposing an appliance for shaping hair, in particular a straightener, which:

- is less bulky and capable of forming regular curls,
- is less bulky and capable of forming curls by way of an easy mode of use,
- is capable of forming curls of at least two different sizes (or diameters) or even at least three different sizes by way of easy use,
- is capable of forming curls at a reduced cost price of this single appliance,
- is capable of forming curls and has a reduced weight,
- is capable of forming curls and is easy to handle, in particular easy to handle in the region of the two handles or gripping zones and without touching the end of the appliance on the treatment side, which may sometimes be hot,
- is strong, in particular strong with respect to impacts, is robust in operation and ages well with respect to mechanical deformations, for example,
- is effective and/or rapid in operation,
- allows easy and practical use,
- has disposable additional elements that are of simple design and of low-cost design,
- is safe and can never burn the scalp or the hands of the user,
- has an increased product life, decreasing the environmental impact of the appliance,
- operates safely, is reliable in operation, providing quality treatment of the hair.

Of course, the invention is in no way limited to the embodiments described and illustrated, which are given only by way of example. Modifications remain possible, in particular from the point of view of the makeup of the various elements or by substituting technical equivalents, without otherwise departing from the scope of protection of the invention.

The invention claimed is:

1. A hair styling appliance comprising:

a first and a second elongate jaw that are pivotable with respect to one another;

the first jaw having a first housing bearing a first flat internal treatment surface;

wherein the first housing comprises at least two longitudinal edges;

the second jaw having a second housing bearing a second flat internal treatment surface;

wherein the second housing comprises at least two longitudinal edges;

wherein the internal treatment surfaces are configured to pinch a lock of hair;

at least one heating element to heat at least one internal treatment surface;

wherein the greatest width of the first housing is less than or equal to 90% of the greatest width of the second housing;

wherein at least one of the first housing and the second housing is asymmetric with respect to a median plane in a longitudinal section of said first housing or said second housing, respectively; and wherein, in cross section, the line defined by the exterior contour of the first and second housings is a rounded curve that does not have any points of inflection.

2. The hair styling appliance of claim 1, wherein the greatest width of the first housing ranges from about 75% to about 85% of the greatest width of the second housing.

3. The hair styling appliance of claim 1, wherein, in the closed position of the jaws, the median plane in longitudinal section of the first housing is parallel to and separate from the median plane in longitudinal section of the second housing.

4. The hair styling appliance of claim 3, wherein the distance between said two median planes ranges from about 5% to about 20% of the value of the greatest width of the second housing.

5. The hair styling appliance of claim 1, wherein, in the closed position of the first and second jaws, one of the at least two longitudinal edges of the first housing is vertically aligned with one of the at least two longitudinal edges of the second housing.

6. The hair styling appliance of claim 5, wherein the internal treatment surfaces of the first and second housings are substantially flat and are substantially identical to and opposite one another in the closed position, and are arranged in their respective housings adjacent to said vertically aligned edges.

7. The hair styling appliance of claim 5, wherein each of said two longitudinal edges is provided with at least one bar that protrudes towards the interior of the housing.

8. The hair styling appliance of claim 1, wherein the width of each internal treatment surface ranges from about 40% to about 60% of the greatest width of the first housing.

9. The hair styling appliance of claim 1, wherein the second housing comprises a comb or a brush that is oriented towards the first housing and adjacent to the second internal treatment surface.

10. The hair styling appliance of claim 9, wherein the first housing has a groove formed in its interior contour and arranged, in the closed position, approximately adjacent to the comb or the brush of the second housing.

11. The hair styling appliance of claim 1, wherein the first jaw comprises a first handle and the second jaw comprises a second handle, wherein the first handle and the second handle each have a width less than the greatest width of the first housing.

12. The hair styling appliance of claim 1, wherein the exterior surfaces of the first housing and the second housing are substantially smooth.

13. A method of using a hair styling appliance to curl the hair, wherein curling the hair forms curls of at least two different sizes, said appliance comprising:

a first and a second elongate jaw that are pivotable with respect to one another;

the first jaw having a first housing bearing a first flat internal treatment surface;

the second jaw having a second housing bearing a second flat internal treatment surface;

wherein the internal treatment surfaces are configured to pinch a lock of hair;

at least one heating element to heat at least one internal treatment surface;

wherein the greatest width of the first housing is less than or equal to 90% of the greatest width of the second housing;

wherein at least one of the first housing and the second housing is asymmetric with respect to a median plane in longitudinal section of said first housing or said second housing, respectively; and wherein, in cross section, the line defined by the exterior contour of the first and second housings is a rounded curve that does not have any points of inflection;

said method comprising:

surrounding the first housing with a lock of hair;

closing the appliance close to the scalp and keeping it immobile for a few seconds;

sliding the appliance towards the free end of the lock in order to demould the lock; and repeating the steps with the second housing.

14. A method of using a hair styling appliance to curl the hair, wherein curling the hair forms curls of at least two different sizes, said appliance comprising:

a first and a second elongate jaw that are pivotable with respect to one another;

the first jaw having a first housing bearing a first flat internal treatment surface;

the second jaw having a second housing bearing a second flat internal treatment surface;

wherein the internal treatment surfaces are configured to pinch a lock of hair;

at least one heating element to heat at least one internal treatment surface;

wherein the greatest width of the first housing is less than or equal to 90% of the greatest width of the second housing;

wherein at least one of the first housing and the second housing is asymmetric with respect to a median plane in longitudinal section of said first housing or said second housing, respectively; and wherein, in cross section, the line defined by the exterior contour of the first and second housings is a rounded curve that does not have any points of inflection;

said method comprising:

inserting a lock of hair between the two housings, closing the appliance around a portion of the lock of hair closest to the scalp then sliding the appliance along the lock to the end of the lock;

winding the lock around both housings, while keeping the appliance closed around the end of the lock;

holding the position for a several seconds, and unwinding the lock.

* * * * *